United States Patent [19]

Squyers, Jr.

[11] Patent Number: 4,905,320

[45] Date of Patent: Mar. 6, 1990

[54] PROTECTIVE BODY SUPPORT

[76] Inventor: Thomas L. Squyers, Jr., 1105 Glenwood, Grand Prairie, Tex. 75057

[21] Appl. No.: 269,445

[22] Filed: Nov. 10, 1988

[51] Int. Cl.[4] ..... A41D 13/06

[52] U.S. Cl. ..... 2/22; 2/2.5; 2/59; 2/243 R; 2/243 A; 2/268

[58] Field of Search ..... 2/2.5, 16, 21, 22, 24, 2/59, 268, 411, 243 A

[56] References Cited

U.S. PATENT DOCUMENTS

| | | | |
|---|---|---|---|
| 1,317,305 | 9/1919 | Miller | 2/24 |
| 2,657,385 | 11/1953 | Cushman et al. | 2/24 |
| 3,513,842 | 5/1970 | Keenan et al. | 2/24 X |
| 3,529,306 | 9/1970 | Thorne | 2/3 |
| 3,552,044 | 1/1971 | Wiele | 2/412 |
| 3,877,076 | 4/1975 | Summers et al. | 2/3 |
| 4,219,892 | 9/1980 | Rigdon | 2/24 |
| 4,250,578 | 2/1981 | Barlow | 2/24 |
| 4,272,850 | 6/1981 | Rule | 2/24 |
| 4,343,047 | 8/1982 | Lazowski et al. | 2/411 |
| 4,370,754 | 2/1983 | Donzis | 2/2 |
| 4,412,358 | 11/1983 | Lavender | 2/412 |

FOREIGN PATENT DOCUMENTS

| | | | |
|---|---|---|---|
| 1069651 | 1/1980 | Canada | 2/23 |
| 5132 | of 1899 | United Kingdom | 2/24 |

*Primary Examiner*—Werner H. Schroeder

*Assistant Examiner*—Jeanette E. Chapman

*Attorney, Agent, or Firm*—Terry M. Gernstein

[57] ABSTRACT

A protective body support for use to protect a wearer's knee, or other such body part, re-directs and dissipates the forces associated with an impact delivered to the body support in such a manner as to prevent the application of a force to the body that is sufficient to harm that body. The body support includes plurality of triangular compartments that are attached at the apex of the triangles to an adjacent element of the support. Energy-absorbing beads are contained in the compartments, and the triangular shapes are oriented so that forces applied to the support are re-directed against the apexes so as to apply shear forces thereto. The apexes are attached so that at a predetermined level of impact force applied to the support, the resultant component applied against the apexes will rupture at least one of the apex connections thereby allowing the beads to spill out of the support compartment located adjacent to the ruptured apex. The rupturing of the apex connection dissipates some of the impact force, and the connection is formed so that it will rupture before the components of the impact force other than the shear force will be low enough so as not to harm the body being protected by the support. The support is adapted to rupture in a manner so as to permit the beads to flow out of the support to further dissipate the impact force and prevent harm to the wearer's body.

8 Claims, 1 Drawing Sheet

PROTECTIVE BODY SUPPORT

TECHNICAL FIELD OF THE INVENTION

The present invention relates to the general field of protective body devices such as knee pads or the like, and to the particular area of protective body devices that absorb impact forces so as to protect the body portion covered by the support. Specifically, the present invention relates to a protective body device that absorbs, re-directs and dissipates impact forces.

BACKGROUND OF THE INVENTION

With participants in contact sports, such as football, hockey, and the like, becoming larger and faster, the potential for injury increases each year. In fact, it has been estimated that as many as ninety percent of all players in the National Football League will suffer some sort of injury that will require them to miss playing time each year.

Human joints, in particular the knee joint, were simply not designed for the sort of punishment it takes in such contact sports. The knee is the single most vulnerable area of an athlete's body, and the one area that is most feared in the event of injury.

Accordingly, there have been many proposals for body protectors. For example, such proposals have varied from a simple knee pad, such as is worn by wrestlers, to more complex devices which include energy absorbing balls, such as is disclosed in Britist Patent No. 5132 (1892), to cushion structures such as is disclosed in U.S. Pat. No. 1,317,305, to still more complex devices that include shifting and moving elements, such as the equalizer device disclosed in U.S. Pat. No. 3,529,306.

Other impact-absorbing devices are also known, such as the helmets disclosed in patents, such as U.S. Pat. Nos. 4,412,358, 4,343,047 and 3,877,076, as well as body padding, such as disclosed in U.S. Pat. Nos. 4,370,754 and 3,552,044.

However, while all of these devices are somewhat effective for low impact situations, they are seriously deficient in fully protecting a joint, such as a knee joint, in some high-impact situations that may occur in modern sports. Still further, there ma be some difficulty in manufacturing such devices, and they still may be overly cumbersome and not be as comfortable to wear as possible as is required for the athlete who is required to be extremely fast, quick and agile.

Still further, these devices do not re-distribute the impact force in an efficient manner from one portion of the wearer's body to another, stronger portion. These devices thus do not serve as efficient body supports.

Accordingly, there is need for a body protector that is easy to manufacture, comfortable to wear, yet protects the wearer's body in all situations which can range from slight impact to high energy impact, and can also serve as an efficient body support.

OBJECTS OF THE INVENTION

It is a main object of the present invention to provide a body protector that protects against high-energy impacts.

It is another object of the present invention to provide a body protector that protects against high-energy impacts while remaining comfortable to wear.

It is another object of the present invention to provide a body protector that protects against high-energy impacts while remaining easily manufactured.

It is another object of the present invention to provide a body protector that can also serve as a body support by re-distributing forces from some areas of the body to other, stronger, areas thereof.

It is a specific object of the present invention to provide a body protector that protects against high-energy impacts by re-directing the forces applied thereto and by including means for dissipating such impact-energy in an efficient manner.

SUMMARY OF THE INVENTION

These, and other, objects are accomplished by providing a body support and joint protector that includes a multiplicity of impact-absorbing balls supported in a baffle system that is designed to rupture in specific areas and in such a manner as to dissipate energy via such rupturing. Since rupturing is a means of dissipating energy, the rupture of one portion of the device will perform this function, and the device includes portions that are designed to break apart at specific values of impact energy.

Upon rupturing, the balls are free to move with respect to each other, and ultimately, to spill out of the baffle section thereby dissipating energy via friction and due to the release of the balls. Ultimately, the entire structure will open to permit the balls to spill out of the device completely thereby further dissipating energy.

The baffling is designed to re-direct impact-energy forces in such a manner that a large component thereof is directed away from the body part being protected, and the balls and rupture points are located and designed so that, upon the application of a predetermined impact force to any portion of the dvice, the baffle will rupture thereby dissipating energy.

Specifically, the support includes the use of energy absorbing beads encased between a double layers of neoprene rubber. These beads, which are manufactured by the 3 M Company, among others, are used for somewhat similar purposes in flak jackets and other items in the law enforcement field. The beads are encased in a triangular baffle system which maintains them in an essentially uniform distribution until pressure is applied. The triangular baffles are attached via the apexes thereof between the two layers of rubber and are formed of flexible, extremely thin material to assume a somewhat corrugated shape. The apexes of the triangles are attached to the adjacent material in a manner which permits a break at such connection when force applied to the support exceeds a predetermined amount. Such a connection will be referred to as a break-away joint. The predetermined amount of force is that force associated with an impact force that would be likely to damage the portion of the body being protected. Thus, the predetermined amount of force will vary with the body part being protected, with, for example, a knee having a different predetermined force than an elbow or a wrist, or the like. Those skilled in the art of sports medicine will be able to determine what the predetermined force will be for each use based on the teaching of the present disclosure. Accordingly, no further discussion will be directed to the selection of the predetermined forces.

The connection of the apexes to the adjacent material can be by sewing, heat sealing, gluing, welding, or other such techniques, and only needs to account for the ease of manufacturing in addition to the production of a break-away attachment that will rupture as required.

The double layers of sheet material forming the baffles are connected at spaced apart locations with pointed, rather than rounded, attachments being accomplished so as to differ somewhat from a conventional corrugated construction. The baffle material is attached to the inner and outer layers of the neoprene rubber by some means which is permanent and which will not allow the material to separate under normal conditions. In this respect, heat molding or gluing would normally be adequate.

DETAILED DESCRIPTION OF THE PREFERRED EMBODIMENTS

Figure 1:
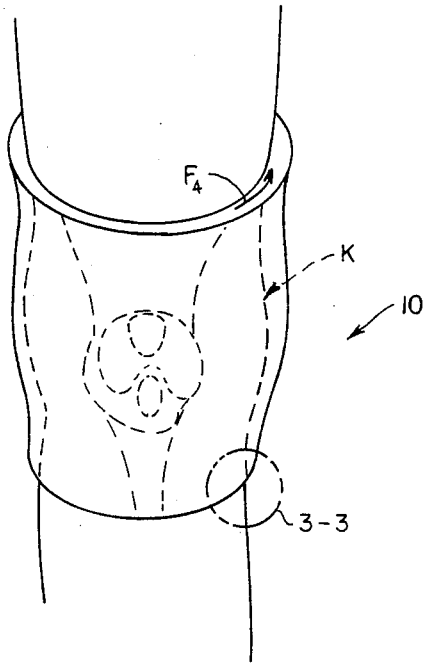
FIG. 1 is a perspective view of the protective body support embodying the present invention and shows the same operably wrapped around a user's knee.
Figure 2:
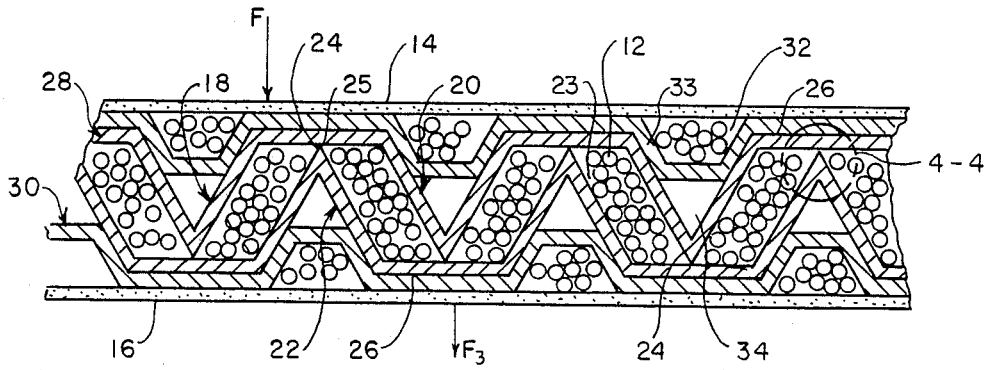
FIG. 2 is a partial cross-sectional view of the body support of the present invention showing its operable internal structure.

With reference now to the drawings, and in particular to FIGS. 1 and 2, a new and improved protective body support embodying the principles and concepts of the present invention is shown, and is generally designated by reference numeral 10.

The body support 10 is shown in the figures as being wrapped around user's knee K, and essentially comprises a energy absorbing bead means which includes a plurality of energy absorbing beads 12 encased in a casing means which includes two outer sheets 14 and 16 of neoprene rubber or some similar flexible shock absorbing material and which are positionable against a user's body. The casing means further has positioned therewithin a baffle means structure 18 which comprises first and second aligned, spaced apart, thin flexible sheets 20 and 22 respectively, with the beads 12 further being encased within that structure 18. The sheets can be manufactured from material such as Gortex or some similar densely woven fabric which is designed to breathe, i.e., permit some permeation of air therethrough.

The sheets 20 and 22 are each formed into a corrugated multiple triangle shape which includes a multiplicity of pockets 23 for encasing the beads 12. Within each corrugated section, one of the sheets, 20 or 22 will be provided with a triangularly-shaped pocket 24 which, in a preferred embodiment, is secured at the apex 25 thereof by some means, such as gluing, welding, or the like, to the opposed facing sheet to form a break-away joint. Adjacent to the point of attachment of each sheet apex 25, the opposed sheet will be provided with a flattened surface 26 to facilitate such attachment, while also defining the desired structural shape of the pocket 23 for encasing the beads 12.

The protective body support 10 further includes additional sheets of material 28 and 30 respectively abutting the adjacent surfaces of the neoprene rubber sheets 14 and 16. The sheet 28 is fixedly secured between the interior surface of the rubber sheet 14 and a surface of the sheet 20, while further being provided with a plurality of trapezoidally-shaped pockets 32 in which additional beads 12 are encased. These pockets 32 are designed to fit within triangular sections of the baffle system 18, as is best illustrated in FIG. 2, with triangular air pockets 34 the being formed between the pockets 32 and the sheet points 24. The pockets 32 have walls 33 which contact the walls of the triangular air pockets 34 to support such walls and hold the shape thereof. Preferably, the air pockets are isosceles triangles in shape.

As best shown in FIG. 2, the balls 12 located adjacent to each apex 25 are positioned to abut a portion of the triangle associated with that apex. In this manner, any forces directed against the device 10, such as indicated in FIG. 2 as F, will be re-directed into components, such as force $F_1$, and into a component that creates a shear force on the apex break-away connection. This re-direction of forces has at least two results: it reduces the force ultimately applied to the body part being protected to a value less than F since force F has been broken down into components; and it also directs some force against the apex connection. The last-mentioned force is indicated in FIG. 2 as $F_2$, and creates a shear force on that connection.

Figure 3:
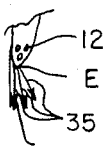
FIG. 3 is a partial cross-sectional view showing a portion of the support after it has ruptured to dissipate impact energy via the mechanism of rupture dissipation.
Figure 4:
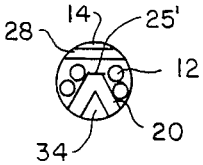
FIG. 4 is a partial cross-sectional view showing a baffle break-away joint, or apex, that has been ruptured by the balls of the support re-directing impact force in a direction that applies shear forces to the apex connection with sufficient magnitude to rupture the connection between the apex and the adjacent material.

The attachment of the apex to the adjacent element can be selected so that when force $F_2$ reaches a predetermined value, the connection will be broken, as is indicated in FIG. 4, with the broken apex being indicated by the indicator 25'. Breaking the connection of any of the apexes will permit the beads in the adjacent pockets to be redistributed, and may even generate a force $F_2$ on an adjacent apex. The redistribution of the beads causes them to rub together thereby generating friction and further dissipating the force. If the force is still too high, an adjacent apex will be broken as the force will be next applied thereto via the beads. The rupture of this apex will further dissipate energy and cause a further shifting of the beads to further dissipate energy. This process will continue until either the total force is sufficiently dissipated, or the final apex adjacent to an edge seam of the device casing means is broken thereby permitting the beads to spew from the device, as indicated in FIG. 3 at a rupture location, such as end edge E. The beads issuing from the device are indicated in FIG. 3 by the reference indicators 35.

Ultimately, the force F will be dissipated and broken down so that any remaining component thereof that is applied against the protected body part in a direction that may cause damage to that body part will be so low as to be safe. The ultimately applied force is indicated in FIG. 2 as force $F_3$.

It can also be seen from an analysis of FIGS. 1 and 2 that as the force F is being re-directed and broken into components, some of the components will be directed against other portions of the body part being protected. This redirection can be arranged so that the forces are directed against that portion of the body part that is strongest and most capable of accommodating such forces. This feature is indicated in FIG. 1 by force $F_4$, and thus permits the device to serve as a support as well as a protector.

Those skilled in the art will be able to design the exact angles and dimensions of the triangles shown in this application based on the teaching of this application and the knowledge associated with sports science and sports medicine. Accordingly, exact angles and dimensions will not be provided herein.

With respect to the manner of use of the present invention, it can be appreciated that the protective body support 10 can be wrapped around a user's knee, such as illustrated in FIG. 1, or around some other appendage, such as a wrist, elbow, ankle, or the like. Upon an impact against the support 10, the beads 12 at the point of impact will shift and disperse somewhat thereby dissipating some of the impact energy via friction, and will also re-direct that force into components to surrounding areas of the baffle and to surrounding beads. As above discussed, the re-directed forces will be applied to the apex connections as shear forces. These apexes will eventually rupture thereby further dissipating energy, and this will continue as a chain reactions until the integrity of the entire device is broken thereby permitting the beads to issue from the device as indicated in FIG. 3. The beads will also move into the air pockets and the beads in pockets 32 may move and break in further absorbing and dissipating the impact force.

Ultimately, the device 10 prevents the direct application of a force F to the body and dissipates and breaks down such force as well as re-directs it so that the force $F_3$ that is ultimately applied to the body will be sufficiently small so that it will not damage the user's body.

I claim:

1. A new and improved protective body support for use on a user's body comprising:

a flexible casing means positionable against a user's body;

energy absorbing bead means contained in said flexible casing means;

baffle means positioned within said flexible casing means, said energy absorbing bead means being retained within said baffle means, said baffle means including two sheets of flexible material, with a first sheet of said two sheets defining a plurality of triangle-shaped compartments each having a first sheet apex that is adapted to be attached to the second sheet of said two sheets, and said second sheet defining a plurality of triangle-shaped compartments each having a second sheet apex that is adapted to be attached to the first sheet;

a break-away joint attaching each of said first sheet baffle means apexes to said second sheet, and each of said second sheet baffle means apexes to said first sheet;

said triangle-shaped compartments having walls that are positioned and oriented to position and orient the bead means within said compartments with respect to said break-away joints so that impact energy associated with an impact to the casing means is re-directed through said bead means to apply shear forces to said break-away joints, said break-away joints being adapted to rupture under the influence of a predetermined amount of shear force, with said predetermined amount of shear force being associated with an impact force on said casing means that is less than that impact force which would damage the user's body.

2. The protective body cover defined in claim 1 wherein said casing means comprises two outer sheets of neoprene rubber.

3. The protective body cover defined in claim 2 wherein said casing means includes a rupture location that ruptures to permit said bead means to flow out of said casing means when the force applied to said casing means exceeds said predetermined force by a preselected amount.

4. The protective body cover defined in claim 3 wherein said rupture location is adjacent to an end edge of said casing means.

5. The protective body cover defined in claim 4 further including air pockets.

6. The protective body cover defined in claim 5 wherein said triangle shaped compartments are isosceles triangles in shape.

7. The protective body cover defined in claim 6 further including additional sheets each fixedly secured between one of said baffle means first and second sheets and one of said casing means outer sheets.

8. The protective body cover defined in claim 7 further wherein said additional sheets form trapezoidally shaped pockets having energy absorbing bead means contained therein, said trapezoidally shaped pockets having walls that contact the walls of said triangle shaped compartments to support such walls.

* * * * *